US012398940B2

(12) United States Patent
Chen et al.

(10) Patent No.: US 12,398,940 B2
(45) Date of Patent: Aug. 26, 2025

(54) AIR-COOLED REFRIGERATOR SUPPLYING AIR THROUGH CENTRIFUGAL FAN

(71) Applicants: QINGDAO HAIER REFRIGERATOR CO., LTD., Shandong (CN); HAIER SMART HOME CO., LTD., Shandong (CN)

(72) Inventors: Jianquan Chen, Qingdao (CN); Xiaobing Zhu, Qingdao (CN); Bin Fei, Qingdao (CN); Changzhi Wang, Qingdao (CN); Chen Feng, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 211 days.

(21) Appl. No.: 18/042,085

(22) PCT Filed: Jun. 15, 2021

(86) PCT No.: PCT/CN2021/100125

§ 371 (c)(1),
(2) Date: Feb. 17, 2023

(87) PCT Pub. No.: WO2021/228277

PCT Pub. Date: Nov. 18, 2021

(65) Prior Publication Data

US 2023/0243568 A1 Aug. 3, 2023

(30) Foreign Application Priority Data

Aug. 18, 2020 (CN) ..... 202010832823.6

(51) Int. Cl.
*F25D 17/06* (2006.01)
*F04D 17/08* (2006.01)
(Continued)

(52) U.S. Cl.
CPC ..... *F25D 17/062* (2013.01); *F04D 17/08* (2013.01); *F04D 29/4233* (2013.01);
(Continued)

(58) Field of Classification Search
CPC ..... F25D 17/062; F25D 17/067; F25D 17/08; F25D 2317/068; F25D 2317/0681;
(Continued)

(56) References Cited

U.S. PATENT DOCUMENTS 5,531,267 A 7/1996 Ahmed et al.
5,911,750 A 6/1999 Mandel et al.
(Continued)

FOREIGN PATENT DOCUMENTS

CN 203641106 U 6/2014
CN 104930790 A 9/2015
(Continued)

OTHER PUBLICATIONS

Machine translation of CN210832696 (Year: 2020).*
(Continued)

*Primary Examiner* — Joseph F Trpisovsky
(74) *Attorney, Agent, or Firm* — troutman pepper locke; Tim Tingkang Xia, Esq.

(57) ABSTRACT

An air-cooled refrigerator supplying air through a centrifugal fan, comprising a bottom liner, an air duct back plate, and the centrifugal fan. A cooling chamber and a storage space are defined in the bottom liner; the air duct back plate is provided in front of a back wall of the bottom liner, and defines an air supply duct with the back wall of the bottom liner; the centrifugal fan comprises a volute and an impeller; the volute is arranged obliquely upwards from front to back at the back of the cooling chamber, and a fan cavity and a gradually widened exhaust cavity are defined in the volute; the fan cavity is formed into a continuous spiral; the gradu-
(Continued)

ally widened exhaust cavity is gradually widen backwards from the fan cavity; the impeller is provided in the fan cavity; and the inner wall face of the fan cavity is continuous and smooth.

12 Claims, 6 Drawing Sheets

(51) Int. Cl.
*F04D 29/42* (2006.01)
*F04D 29/66* (2006.01)
*F25D 17/08* (2006.01)

(52) U.S. Cl.
CPC ..... *F04D 29/668* (2013.01); *F25D 17/08* (2013.01); *F25D 2323/0028* (2013.01)

(58) Field of Classification Search
CPC ..... F25D 2323/0028; F04D 17/08; F04D 29/4233; F04D 29/668
See application file for complete search history.

(56) References Cited

U.S. PATENT DOCUMENTS

| | | | | |
|---|---|---|---|---|
| 9,456,706 | B2 | 10/2016 | Nguyen et al. | |
| 2016/0298652 | A1* | 10/2016 | Saturley | H05K 7/20172 |
| 2019/0368507 | A1* | 12/2019 | Xu | F04D 29/444 |
| 2022/0163250 | A1 | 5/2022 | Wang et al. | |

FOREIGN PATENT DOCUMENTS

| | | | |
|---|---|---|---|
| CN | 106152663 | A | 11/2016 |
| CN | 110375491 | A | 10/2019 |
| CN | 209893738 | U | 1/2020 |
| CN | 110905854 | A | 3/2020 |
| CN | 210832696 | U | 6/2020 |
| CN | 213040840 | U | 4/2021 |
| CN | 213040841 | U | 4/2021 |
| EP | 2628416 | B1 | 1/2015 |

OTHER PUBLICATIONS

Machine translation of CN 110905854 (Year: 2020).*
International Search Report and Written Opinion for PCT/CN2021/100125 (ISA/CN) mailed Aug. 27, 2021 w/partial English translation (10 pages).
1st Office Action for China Application No. 202010832823.6 dated Sep. 6, 2022 (9 pages).
European Search Report for European Patent Application No. 21803711.7 dated Oct. 24, 2023 (4 pages).
1st Office Action for European Patent Application No. 21803711.7 dated Nov. 17, 2023 (6 pages).
1st Examination Report for Australian Patent Application No. 2021270948 dated Nov. 30, 2023 (3 pages).

* cited by examiner

AIR-COOLED REFRIGERATOR SUPPLYING AIR THROUGH CENTRIFUGAL FAN

CROSS-REFERENCE TO RELATED APPLICATIONS

The present application is a national phase entry of International Application No. PCT/CN2021/100125, filed Jun. 15, 2021, which claims priority to Chinese Application No. 202010832823.6, filed Aug. 18, 2020, which are each incorporated herein by reference in its entirety.

FIELD OF THE INVENTION

The present invention relates to a refrigerating and freezing technology, and more particularly relates to an air-cooled refrigerator supplying air through a centrifugal fan.

BACKGROUND OF THE INVENTION

A fan is one of essential devices of a refrigerator, and is commonly arranged in a fan volute so as to supercharge cooling airflow. But the fan volute in the prior art does not belong to an optimal helix design and has a wall surface turning point, and thus, fluid pressure cannot be naturally transferred on an inner wall surface via transition. When a fluid passes through the turning point, a flow state and a flow rate of the fluid will obviously change, which causes a pressure section difference and aerodynamic noise, thereby influencing user experience feeling.

BRIEF DESCRIPTION OF THE INVENTION

An objective of the present invention aims to overcome at least one defect in the prior art, and provide an air-cooled refrigerator supplying air through a centrifugal fan.

A further objective of the present invention aims to optimize flow characteristics of refrigeration airflow and reduce energy consumption.

Another further objective of the present invention aims to simplify an installation process of the refrigerator.

Particularly, the present invention provides an air-cooled refrigerator supplying air through a centrifugal fan, including:

a bottom liner defining a cooling chamber and a storage space, where the cooling chamber is arranged below the storage space;

an air duct back plate which is arranged in front of a rear wall of the bottom liner and defines, with the rear wall of the bottom liner, an air supply duct, where the air duct back plate is provided with at least one air supply port used for communicating with the air supply duct and the storage space; and the centrifugal fan, including:

a volute arranged at a rear portion of the cooling chamber in a manner of upwards inclining from front to back and internally defining a fan cavity located in a front portion and a gradually-widened exhaust cavity located at a rear portion of the fan cavity, where the fan cavity is in a continuous helix shape, an upper cover of the fan cavity is provided with an air inlet towards a front-upper direction, the gradually-widened exhaust cavity is gradually widened backwards from the fan cavity, and an air outlet connected to a lower end of the air supply duct is formed in a rear end of the exhaust cavity; and an impeller arranged in the fan cavity, where an axis of the impeller is opposite to the air inlet, to promote formation of refrigeration airflow exhausted to the air supply duct from the cooling chamber, and an inner wall surface of the fan cavity is in continuous and smooth transition so as to avoid a turning point.

Furthermore, starting from the air outlet, a side wall of a transverse side of the gradually-widened exhaust cavity is inwards gradually concaved from back to front and is finally connected to a side wall of the fan cavity so as to form a volute tongue with the side wall of the fan cavity, and a side wall of the other transverse side of the gradually-widened exhaust cavity is in a plane shape extending front and back; and the side wall of the fan cavity is in a continuous logarithmic spiral from the volute tongue, and is finally connected to a front end of the plane-shaped side wall of the gradually-widened exhaust cavity.

Furthermore, a distance between a center of the air inlet and the side wall of the fan cavity is gradually increased from the volute tongue to a position connected to the plane-shaped side wall of the gradually-widened exhaust cavity.

Furthermore, distances between the center of the air inlet and side plates on two sides of the bottom liner are different, where the distance between the center of the air inlet and the side plate on the side, close to the volute tongue, of the bottom liner is greater than the distance between the center of the air inlet and the side plate on the side, close to the plane-shaped side wall of the gradually-widened exhaust cavity, of the bottom liner.

Furthermore, the volute includes:

a fan bottom shell fixed to a rear portion of a bottom wall of the bottom liner; and a fan upper cover obliquely downwards extending into the cooling chamber from a lower end of the air duct back plate and covering and buckling the fan bottom shell.

Furthermore, the fan upper cover and the air duct back plate are an integrally-formed part.

Furthermore, a position, below the air supply port, of the air duct back plate is further provided with at least one transversely extending water stop rib used for stopping condensate water at the air supply port from downwards flowing into the volute.

Furthermore, the air-cooled refrigerator further includes:

an evaporator which is integrally in a flat cuboid shape and is arranged at a front portion of the cooling chamber.

The bottom wall of the bottom liner includes:

an evaporator support portion used for supporting the evaporator; and a fan support portion, from a rear end of the evaporator support portion, upwards obliquely arranged from front to back, where the fan bottom shell is fixed to the fan support portion.

Furthermore, a bottom of the fan bottom shell is provided with a plurality of damping sticky pads, and the fan bottom shell is bonded with the fan support portion through the plurality of damping sticky pads.

Furthermore, the fan bottom shell is further provided with a wiring channel used for accommodating a cable connecting the impeller.

In the air-cooled refrigerator of the present invention, the fan cavity and the gradually-widened exhaust cavity are formed in the volute for accommodating the centrifugal fan, the fan cavity is in the continuous helix shape, the gradually-widened exhaust cavity is configured to be backwards gradually widened from the fan cavity, the inner wall surface of the fan cavity is in continuous and smooth transition so as to smoothly guide refrigeration airflow supercharged by the centrifugal fan to the gradually-widened exhaust cavity, thereby avoiding an airflow turning point, and reducing energy losses of the refrigeration airflow as much as possible, and technical effects of the air-cooled refrigerator have been verified by trial products.

Furthermore, in the air-cooled refrigerator of the present invention, the air duct back plate and the fan upper cover are the integrally-formed part so as to form modularization and facilitate batched production. During assembling, an installer can firstly install the integrally-formed part, and then can directly connect an evaporator upper cover with the integrally-formed part, which not only can simplify an installation process and reduce costs, but also make a whole air duct structure more stable.

Specific embodiments of the present invention are described in detail as below by combining drawings, and those skilled in the art will more clearly understand the above and other purposes, advantages and features of the present invention.

BRIEF DESCRIPTION OF THE DRAWINGS

Some specific embodiments of the present invention are exemplarily described without limitation in detail by referring to the drawings below. Same reference numerals in the drawings mark same or similar components or parts. Those skilled in the art should understand that the drawings are unnecessarily drawn to scale. In the drawings.

DETAILED DESCRIPTION

In the description of the embodiments, it needs to be understood that directions or position relationships indicated by terms "longitudinal", "transverse", "length", "width", "thickness", "upper", "lower", "front", "back", "left", "right", "vertical", "horizontal", "top", "bottom", "depth", etc. refer to directions in a normal usage state of a refrigerator and can be determined by referring to directions or position relationships shown in drawings. For example, "front" indicating the direction refers to a side, towards a user, of the refrigerator. The directions or position relationships are merely used for conveniently describing the present invention and simplifying the description, but do not indicate or imply that referred devices or components must be in specific directions or structured and operated in specific directions, and thus should not be understood as limitations to the present invention.

Figure 1:
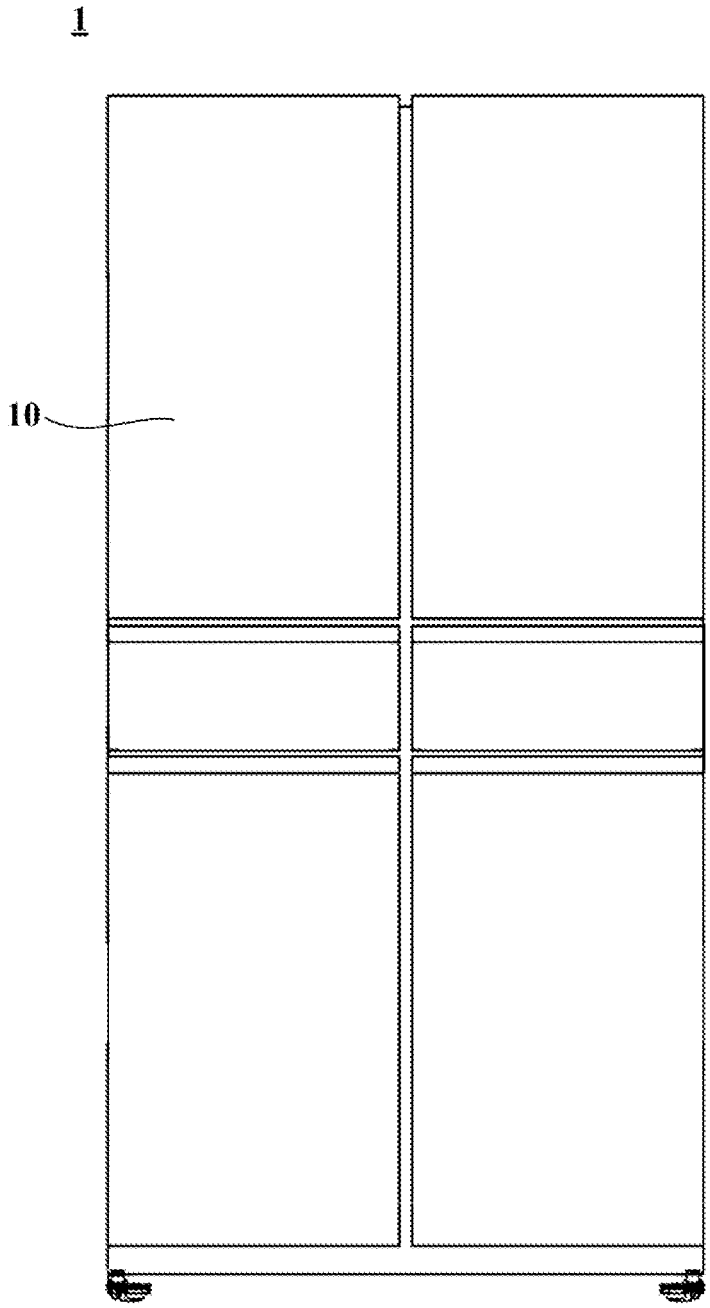
FIG. 1 is a schematic diagram of a refrigerator according to an embodiment of the present invention.

Referring to FIG. 1, a refrigerator 1 in the embodiment commonly may include a cabinet 10, and the cabinet 10 may include a shell, a liner, a thermal insulation layer, other accessories, etc. The shell is an outer-layer structure of the refrigerator, and protects the whole refrigerator. To isolate heat conduction to an outside, the thermal insulation layer is additionally arranged between the shell and the liner of the cabinet 10 and is commonly formed by a foaming technology. There may be one or more liners. The liners may be divided into a refrigeration liner, a variable-temperature liner, a freezing liner, etc. according to functions at will, and the specific number and functions of the liners may be configured according to usage requirements of the refrigerator. In the embodiment, the liner at least includes a bottom liner 100 commonly being the freezing liner.

Figure 2:
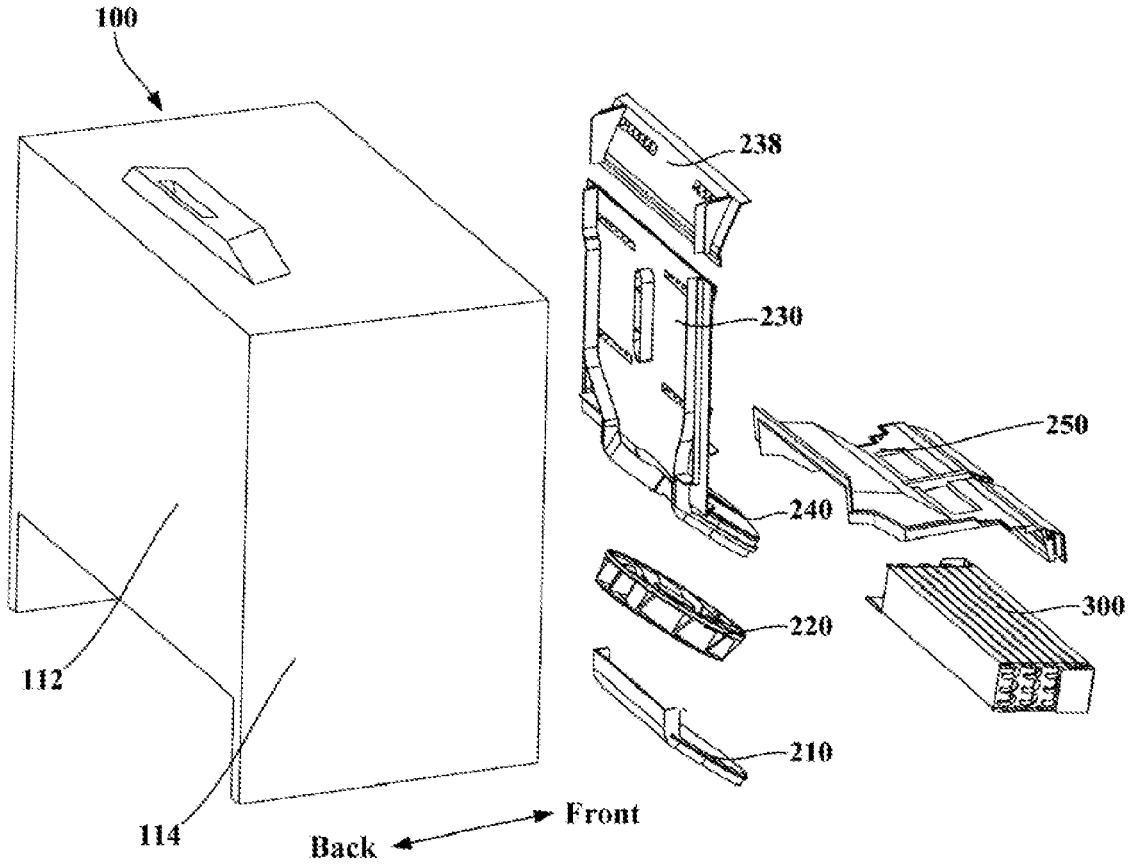
FIG. 2 is an exploded view of a refrigerator according to an embodiment of the present invention, in which a shell is hidden.
Figure 3:
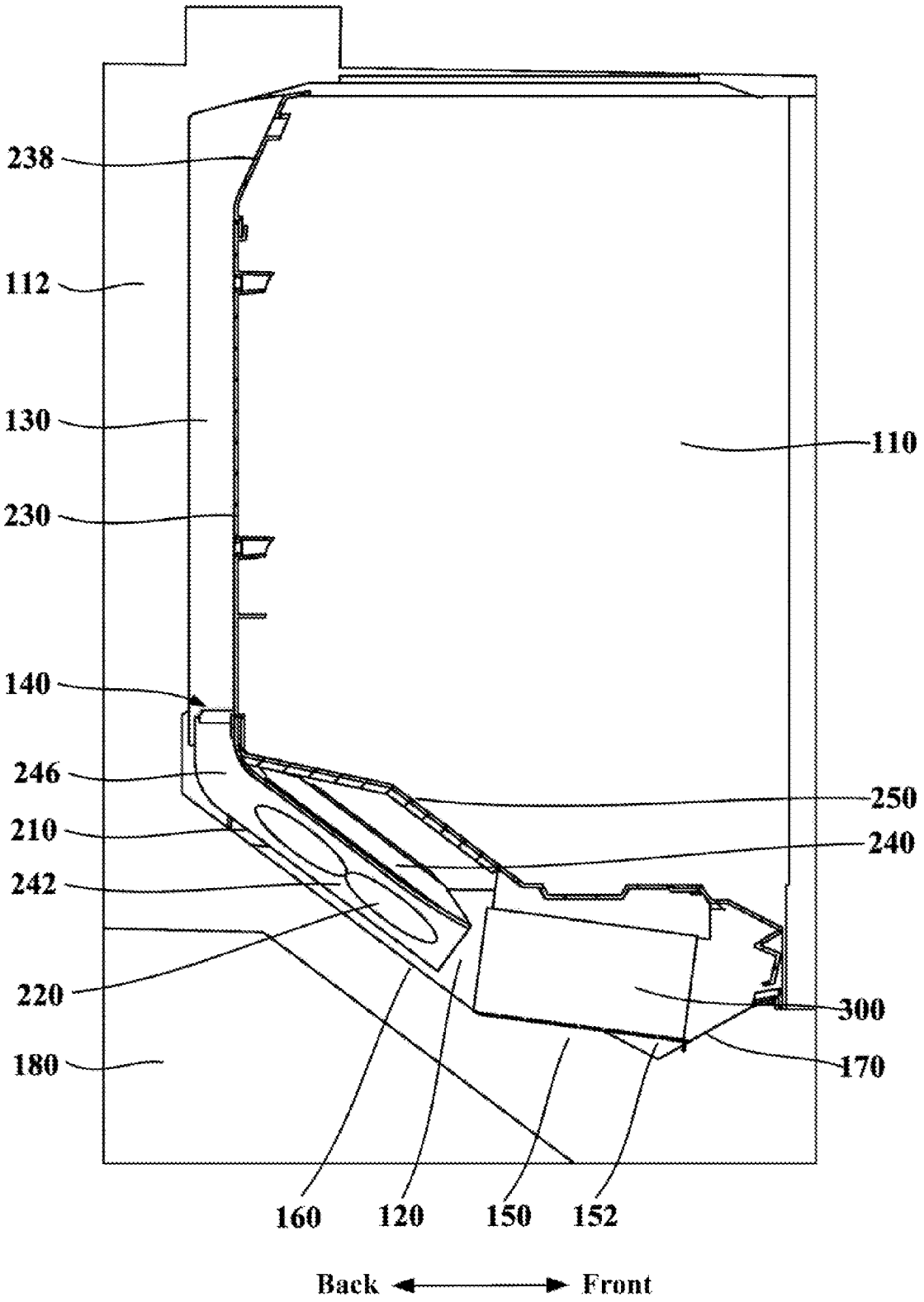
FIG. 3 is a section view of a refrigerator according to an embodiment of the present invention, in which a shell is hidden.

Referring to FIG. 2 and FIG. 3, an air-cooled refrigerator 1 in the embodiment may further include a bottom liner 100, a storage space 110 and a cooling chamber 120 are defined in the bottom liner 100, and the cooling chamber 120 is arranged below the storage space 110. An evaporator upper cover 250 is arranged below the bottom liner 100, transversely arranged in the bottom liner 100 and used for defining the storage space 110 and the cooling chamber 120 in the liner 100. The cooling chamber 120 is arranged below the storage space 110, and an evaporator 300 is arranged in the cooling chamber 120.

Namely, the evaporator 300 in the embodiment is located at a lower part of the bottom liner 100, which avoids a situation that an evaporator of a conventional refrigerator occupies a rear space of a freezing chamber, and consequently a depth of the freezing chamber is reduced; and especially for a side-by-side refrigerator, it is particularly important to increase a depth of a freezing chamber in response to a small transverse size of the freezing chamber. Thus, a space utilization rate of the refrigerator 1 is improved, thereby facilitating storage of large objects difficult to be divided.

In addition, a bottommost freezing chamber in the conventional refrigerator is located at a low position, and thus a user needs to deeply stoop or squat down so as to take and place objects in the freezing chamber, which is inconvenient for the user, particularly for old people. However, in the embodiment, the cooling chamber 120 occupies a lower space of the bottom liner 100, as a result, a height of the storage space 110 above the cooling chamber 120 is increased, and a stoop degree when the user takes and places the objects in the storage space 110 is reduced, thereby improving use experience of the user.

In the embodiment, the evaporator 300 is integrally in a flat cuboid shape, is arranged at a front portion of the cooling chamber 120, and is obliquely arranged in the cooling chamber 120. The manner breaks through a technical constraint that an evaporator needs to be horizontally placed to reduce a depth in the prior art. Inclined placement of the flat-cuboid evaporator 300 increases a length in a front-back direction, but makes arrangement of other components in the cooling chamber 120 more reasonable; and in addition, a practical airflow field analysis proves that air circulation efficiency is higher and water drainage is smoother. A layout manner of inclined arrangement of the evaporator 300 is one of main technological improvements made by the embodiment. In some specific embodiments, an inclination angle of the evaporator 300 ranges from 7 degrees to 8 degrees, e.g., 7 degrees, 7.5 degrees and 8 degrees, preferably 7.5 degrees.

Referring to FIG. 2 to FIG. 5, the air-cooled refrigerator 1 in the embodiment may further include an air duct back plate 230 and a centrifugal fan. The air duct back plate 230 is arranged in front of a rear wall 112 of the bottom liner 100, may serve as at least one part of an air duct plate of the bottom liner 100, is roughly parallel to the rear wall 112 of the bottom liner 100, and defines, with the rear wall 112 of the bottom liner 100, an air supply duct 130. In addition, the air duct back plate 230 is provided with at least one air supply port 232 used for communicating with the air supply duct 130 and the storage space 110.

The centrifugal fan may further include a volute and an impeller 220. The volute is arranged at a rear portion of the cooling chamber 120 in a manner of upwards inclining from front to back and internally defines a fan cavity 242 in a front portion and a gradually-widened exhaust cavity 246 located at a rear portion of the fan cavity 242, where the fan cavity 242 is in a continuous helix shape, and an upper cover of the fan cavity is provided with an air inlet 244 towards a front-upper direction; and the gradually-widened exhaust cavity 246 is backwards widened gradually from the fan cavity 242, and an air outlet 140 connected to a lower end of the air supply duct 130 is formed in a rear end of the exhaust cavity. The impeller 220 is arranged in the fan cavity 242, an axis 222 of the impeller 220 is opposite to the air inlet 244 so as to promote formation of refrigeration airflow exhausted towards the air supply duct 130 from the cooling chamber 120, and an inner wall surface 242*a* of the fan cavity 242 is in continuous and smooth transition so as to avoid a turning point.

In the embodiment, the centrifugal fan can exhaust airflow from the air inlet 244 in a direction perpendicular to the air inlet 244. After airflow in the cooling chamber 120 is sucked by the centrifugal fan from the air inlet 244, the airflow is exhausted into the fan cavity 242 in a direction perpendicular to the air inlet 244, and then enters the gradually-widened exhaust cavity 246 through the fan cavity 242. The gradually-widened exhaust cavity 246 connects the fan cavity 242 with the air supply duct 130, and finally, the refrigeration airflow supercharged by the centrifugal fan is exhausted into the air supply duct 130.

The air supply duct 130 is jointly defined by the air duct back plate 230 and the rear wall 112 of the bottom liner 100. The air duct back plate 230 is provided with at least one air supply port 232 used for communicating the air supply duct 130 with the storage space 110. The refrigeration airflow exhausted into the air supply duct 130 can be exhausted into the storage space 110 from the air supply port 232 so as to exchange heat with hot air in the storage space 110, thereby cooling the storage space 110. A front side of the evaporator upper cover 250 may be further provided with an air return port (unshown in drawings) communicating the storage space 110 with the cooling chamber 120. Hot air subjected to heat exchange may flow back into the cooling chamber 120 from the air return port to continuously exchange heat with the evaporator 300, thereby forming a circulating airflow path.

In the embodiment, the inner wall surface 242*a* of the fan cavity 242 for accommodating the impeller 220 is in continuous and smooth transition. Continuous and smooth transition mentioned herein may be understood as the inner wall surface 242*a* of the fan cavity 242 being a section of continuous and smooth arc wall surface so as to smoothly guide the refrigeration airflow supercharged by the centrifugal fan into the gradually-widened exhaust cavity 246, thereby reducing probability of turning point occurrence, greatly reducing vortexes generated due to a turning point in an airflow field, and reducing energy losses of the refrigeration airflow as much as possible.

In some embodiments of the present invention, starting from the air outlet 140, a side wall of a transverse side of the gradually-widened exhaust cavity 246 is inwards gradually concaved from back to front and is finally connected to a side wall of the fan cavity 242 so as to form a volute tongue 248 with the inner wall surface 242*a* of the fan cavity 242, and a side wall of the other transverse side of the gradually-widened exhaust cavity 246 is in a plane shape extending front and back; and the inner wall surface 242*a* of the fan cavity 242 is in a continuous logarithmic spiral from the volute tongue 248, and is finally connected to a front end of the plane-shaped side wall of the gradually-widened exhaust cavity 246.

Figure 5:
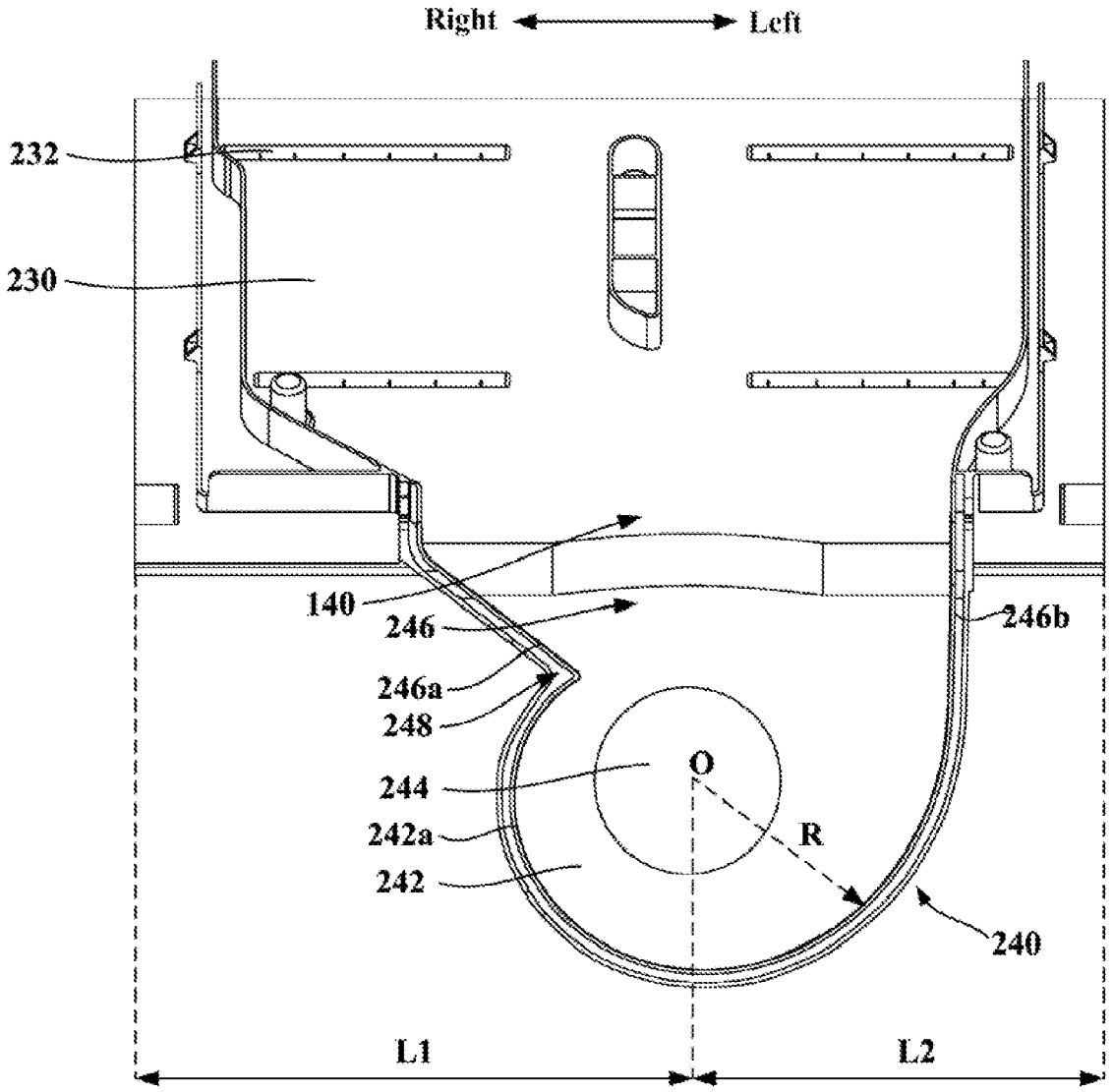
FIG. 5 is a schematic diagram of an installation relationship of a fan upper cover and an air duct back plate observed facing a bottom of the fan upper cover in a refrigerator according to an embodiment of the present invention.

Referring to FIG. 5, the side walls of the gradually-widened exhaust cavity 246 in the embodiment may include a first side wall 246*a* close to the volute tongue 248 and a second side wall 246*b* away from the volute tongue 248, and the first side wall 246*a* and the second side wall 246*b* are located at opposite positions so as to jointly define the gradually-widened exhaust cavity 246. Starting from one side of the air outlet 140, the first side wall 246*a* is inwards gradually concaved from back to front. The second side wall 246*b* is in a plane shape extending front and back and extends to the inner wall surface 242*a* of the fan cavity 242 from the other side of the air outlet 140. Namely, the first side wall 246*a*, the inner wall surface 242*a* of the fan cavity 242 and the second side wall 246*b* are sequentially arranged. The volute tongue 248 is formed at a joint of the first side wall 246*a* and the inner wall surface 242*a* of the fan cavity 242 so that part of airflow in the fan cavity 242 can internally and circularly flow nearby the volute tongue 248, thereby optimizing flow characteristics of the airflow. Technical effects achieved by the volute tongue 248 formed in the volute and the inner wall surface 242*a* of the fan cavity 242 in a logarithmic spiral in the embodiment have been verified by trial products.

It needs to be explained that the direction from back to front may be understood as a direction from the air supply duct 130 to the storage space 110, and an inward direction may be understood as a direction towards the inner wall surface 242*a* of the fan cavity 242.

In some specific embodiments, a distance between a center of the air inlet 244 and the inner wall surface 242*a* of the fan cavity 242 is gradually increased from the volute tongue 248 to a position connected to the plane-shaped side wall of the gradually-widened exhaust cavity 246.

Referring to FIG. 5, a point O in FIG. 5 represents the center of the air inlet 244, and R represents the distance between the center of the air inlet 244 and the inner wall surface 242*a* of the fan cavity 242. Obviously, the inner wall surface 242*a* of the fan cavity 242 may be gradually widened from an end close to the volute tongue 248 to an end away from the volute tongue 248, which further optimizes the flow characteristics of airflow, and technical effects have been verified by trial products.

In some embodiments of the present invention, distances between the center of the air inlet 244 and side plates 114 on two sides of the bottom liner 100 are different, where the distance between the center of the air inlet 244 and the side plate 114 on the side, close to the volute tongue 248, of the bottom liner 100 is greater than the distance between the center of the air inlet 244 and the side plate 114 on the side, close to the plane-shaped side wall of the gradually-widened exhaust cavity 246, of the bottom liner 100.

Referring to FIG. 2 and FIG. 5, L1 in FIG. 5 represents a distance between the center O of the air inlet 244 and a side edge, close to the volute tongue 248, of the air duct back plate 230, and L2 represents a distance between the center O of the air inlet 244 and a side edge, away from the volute tongue 248, of the air duct back plate 230. The air duct back plate 230 is located in front of the rear wall 112 of the bottom liner 100, and the side edges of the air duct back plate 230 are connected to the side plates 114 of the bottom liner 100 respectively. Namely, L1 may represent the distance between the center O of the air inlet 244 and the side plate 114 on the side, close to the volute tongue 248, of the bottom liner 100, and L2 may represent the distance between the center O of the air inlet 244 and the side plate 114 on the side, away from the volute tongue 248, of the bottom liner 100. Obviously, as shown in FIG. 5, L1 is longer than L2. In other words, the air inlet 244 is not located in a middle below the air duct back plate 230, and the unique arrangement is concluded by an inventor via multi-time experiments, thereby further optimizing the flow characteristics of the airflow. In addition, the arrangement manner can make the centrifugal fan located on one side of the cooling chamber 120 so as to vacate a part of space below the centrifugal fan, thereby conveniently arranging a pipe section of the evaporator 300 or other components, and then arranging the whole cooling chamber 120 more reasonably and compactly.

Referring to FIG. 2 to FIG. 6, in some embodiments of the present invention, the volute includes a fan bottom shell 210 and a fan upper cover 240. The fan bottom shell 210 is fixed to a rear portion of a bottom wall of the bottom liner 100; and the fan upper cover 240 obliquely downwards extends into the cooling chamber 120 from a lower end of the air duct back plate 230 and covers and buckles the fan bottom shell 210.

In the embodiment, the fan upper cover 240 is located above the fan bottom shell 210, namely, the air inlet 244 may be formed in the fan upper cover 240, and the fan bottom shell 210 and the fan upper cover 240 may jointly define the fan cavity 242 and the gradually-widened exhaust cavity 246 in the above embodiments. After being connected, the fan bottom shell 210 and the fan upper cover 240 may obliquely downwards extend into the cooling chamber 120 as well, and the air outlet 140 is formed in a position where a rear end of the fan bottom shell 210 is connected to the air duct back plate 230.

Figure 6:
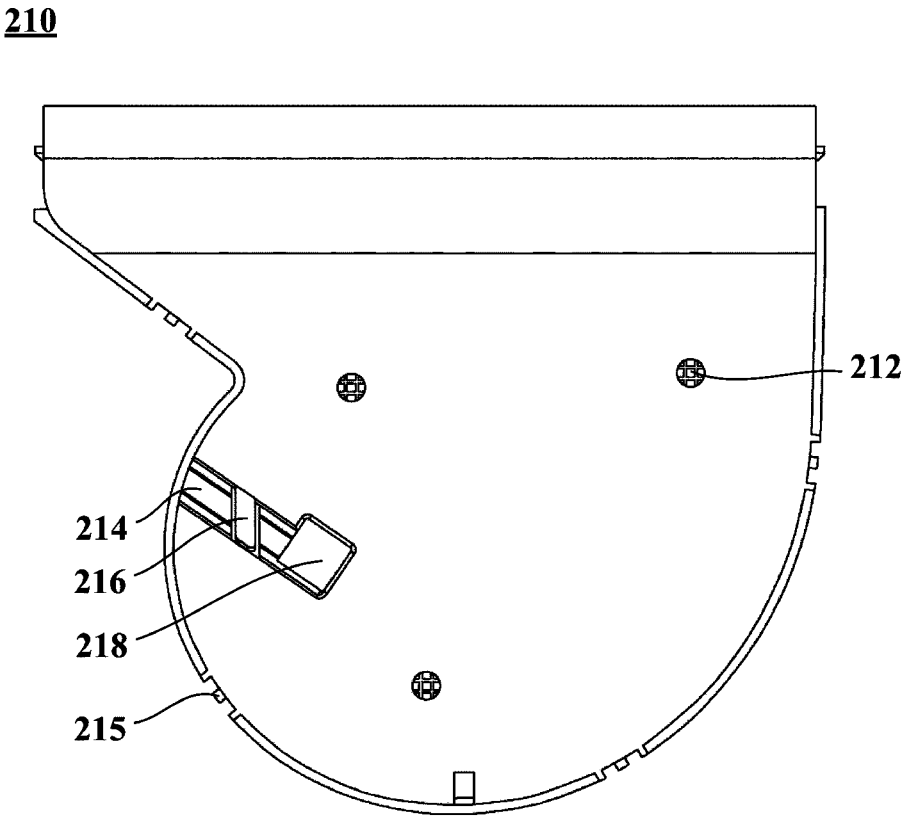
FIG. 6 is a bottom view of a fan bottom shell in a refrigerator according to an embodiment of the present invention, which shows damping sticky pads and a wiring channel.

Referring to FIG. 6, the fan bottom shell 210 and the fan upper cover 240 may be connected together in a clamping connection form. Specifically, a plurality of clamp hooks 215 are arranged on an outer edge of the fan bottom shell 210. Correspondingly, the fan upper cover 240 may be provided with a plurality of buckles (unshown in drawings) matched with the clamp hooks 215. Through the clamp hooks 215 and the buckles, the fan bottom shell 210 and the fan upper cover 240 may be fixedly connected together and are convenient to dismount and mount. Of course, connection may be performed through other fixing manners which are not repeated.

Furthermore, the fan upper cover 240 and the air duct back plate 230 are an integrally-formed part. The manner is different from an air duct plate and a fan volute in the prior art. In the existing refrigerator, an air duct plate and a fan volute arranged in an air duct are commonly two devices relatively independent. During assembling, an installer commonly needs to connect the air duct plate with the fan volute through a large number of fasteners, which will cause a complex installing technology, increases costs and does not facilitate batched production.

However, the air duct back plate 230 and the fan upper cover 240 in the embodiment are the integrally-formed part so as to form modularization and facilitate batched production. During assembling, the installer can firstly install the integrally-formed part, and then can directly connect the evaporator upper cover 250 with the integrally-formed part, which not only can simplify an installation process and reduce costs, but also make a whole air duct structure more stable.

Figure 4:
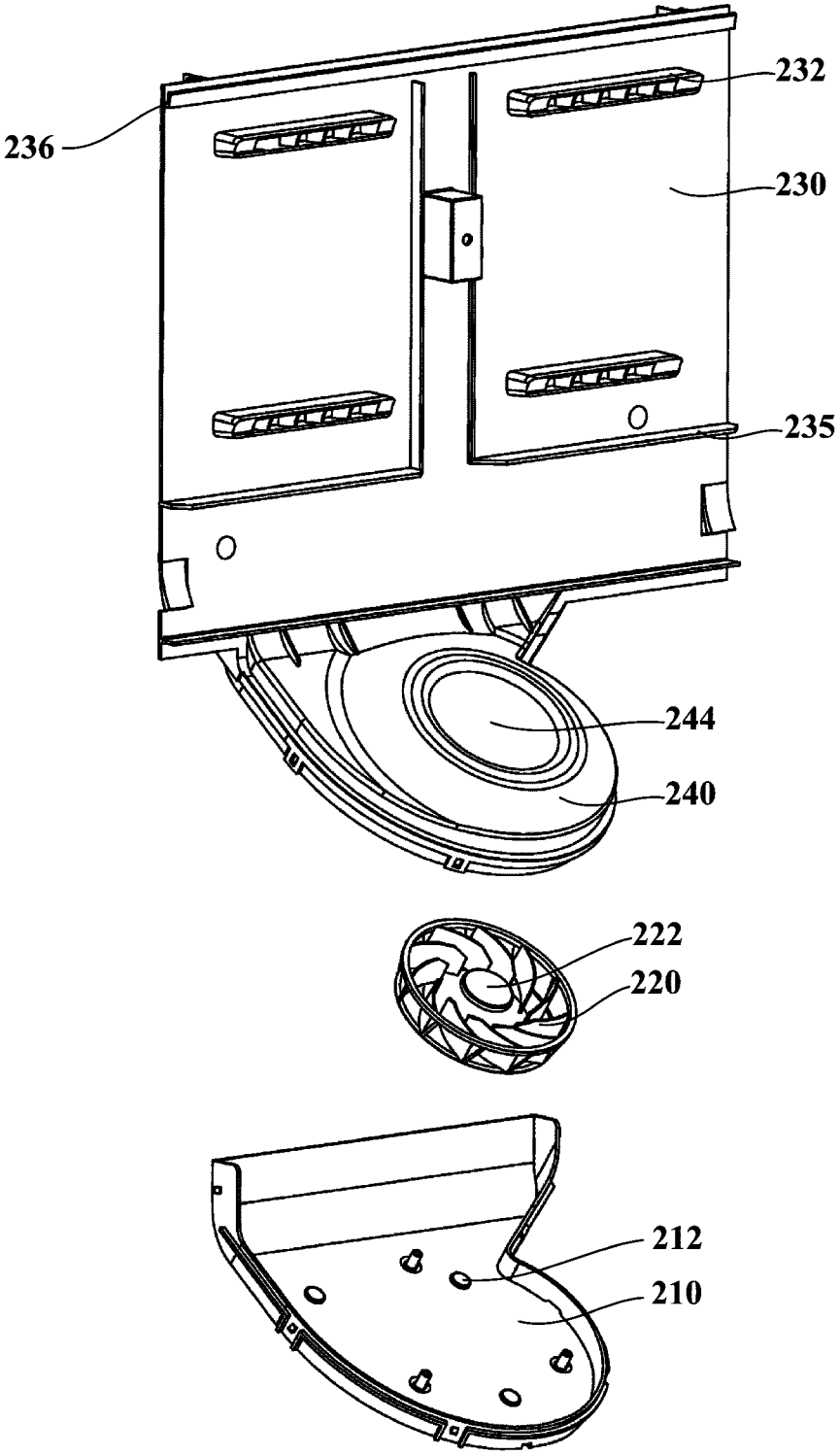
FIG. 4 is a position relationship diagram of a fan bottom shell, an impeller, a fan upper cover and an air duct back plate of a refrigerator according to an embodiment of the present invention, in which a bending section above the air duct back plate is hidden.

Referring to FIG. 4, in some embodiments of the present invention, a position, below the air supply port 232, of the air duct back plate 230 is further provided with at least one transversely extending water stop rib 235 used for stopping condensate water at the air supply port 232 from downwards flowing into the volute.

In the embodiment, the water stop rib 235 may be arranged on one side, towards the storage space 110, of the air duct back plate 230. Since airflow contains part of condensate water, the condensate water can be attached to a surface of the air duct back plate 230 when the airflow encounters the air duct back plate 230, and the water stop rib 235 can reduce a falling speed of the condensate water to make all the condensate water evaporate as much as possible, and prevent the condensate water from falling into the fan cavity 242 and causing faults.

In the embodiment, transversely extending may refer to horizontal extension and may also be understood that the water stop rib 235 has a certain inclination angle. The two above manners both can reduce the falling speed of the condensate water on the water stop rib 235.

Referring to FIG. 3, in some embodiments of the present invention, the bottom wall of the bottom liner 100 may include an evaporator support portion 150 and a fan support portion 160. The evaporator support portion 150 is used for supporting the evaporator 300; and the fan support portion 160, from a rear end of the evaporator support portion 150, is upwards obliquely arranged from front to back, and the fan bottom shell 210 is fixed to the fan support portion 160, so that the fan cavity 242 is integrally obliquely disposed at a rear portion of the evaporator 300.

In the embodiment, the evaporator support portion 150 and the fan support portion 160 are connected and may serve as a part of a partition plate for dividing a liner 100 and a compressor chamber 180 in the cabinet 10. A front portion of the evaporator support portion 150 may further be provided with an inclined portion 170. The inclined portion 170, from a front end of the bottom wall of the bottom liner 100, is downwards obliquely arranged from front to back. The evaporator support portion 150, from a rear end of the inclined portion 170, is upwards obliquely arranged from front to back so that the evaporator 300 can be obliquely arranged in the cooling chamber 120. A drainage channel 152 is formed in a position where the inclined portion 170 is connected to the evaporator support portion 150 so as to receive defrosted water on the evaporator 300.

The fan support portion 160, from a rear end of the evaporator support portion 150, is upwards obliquely arranged from front to back. In some preferable embodiments, an inclination angle of the fan support portion 160 is greater than that of the evaporator support portion 150, the inclination angle of the fan support portion 160 relative to a horizontal direction is set as 36-37 degrees, e.g., 36 degrees, 36.5 degrees and 37 degrees, preferably 36.7 degrees. Correspondingly, the fan bottom shell 210 acts on the fan support portion 160 and may similarly has the above angle inclination setting.

Referring to FIG. 6, in some embodiments of the present invention, a bottom of the fan bottom shell 210 is provided with a plurality of damping sticky pads 212, and the fan bottom shell 210 is bonded with the fan support portion 160 through the plurality of damping sticky pads 212.

The damping sticky pads 212 may be made from flexible materials with viscous force. The bottom of the fan bottom shell 210 is provided with three outwards-protruding damping sticky pads 212 roughly distributed at a lower portion of the fan bottom shell 210 by 120 degrees so as to bond the fan support portion 160 and the fan bottom shell 210. Meanwhile, the damping sticky pads 212 made from the flexible materials can further effectively reduce noise generated during operation of fan blades 220, and simultaneously reduce vibration transfer efficiency during operation of the fan blades 220, improving user experience feeling. It needs to be explained that two, or four, or five or more damping sticky pads 212 may be set, and the present invention does not specially limit the specific number and distribution positions of the damping sticky pads 212.

Referring to FIG. 6, in some embodiments of the present invention, the fan bottom shell 210 is further provided with a wiring channel 214 used for accommodating a cable connecting the impeller 220.

Specifically, the bottom of the fan bottom shell 210 is inwards concaved to form the wiring channel 214, and in other words, the wiring channel 214 is located in an outer surface of the fan bottom shell 210. An elastic wire pressing plate 216 may be arranged above a surface of the wiring channel 214, and a front portion of the wiring channel 214 may also be provided with a wire hole 218. The cable of the impeller 220 may be arranged in the wiring channel 214 in a length direction, and the elastic wire pressing plate 216 may fix the cable of the impeller 220, thereby preventing the cable from loosening and sliding out of the wiring channel 214. The cable of the impeller 220 enters an inner surface of the fan bottom shell 210 (namely, enters the fan cavity 242) through the wire hole 218 after being fixed by the wiring channel 214 and the elastic wire pressing plate 216, and then may be electrically connected to the impeller 220.

Referring to FIG. 2 to FIG. 4, in some embodiments of the present invention, the air duct back plate 230 is a single-layer board integrally formed by injection molding. An upper portion of the air duct back plate 230 is provided with a folding groove 236, and accordingly, the air duct back plate 230 can be conveniently bent by the folding groove 236 during installation.

In the embodiment, the upper portion of the air duct back plate 230 is provided with a bending section 238, a lower portion of the bending section 238 may stretch into the folding groove 236 and can rotate around the folding groove 236 by a certain angle so as to shorten a height of the air duct back plate 230. During installation, the installer can stretch the bending section 238 into the folding groove 236 and outwards rotate the bending section 238 by a certain angle so as to shorten the height of the air duct back plate 230. Then, the installer can connect the rest of positions of the air duct back plate with the liner 100 or other components, and then overturns and restores the bending section 238 so as to simplify an installation process.

Herein, those skilled in the art can realize that although the Description has shown and described a plurality of exemplary embodiments of the present invention in detail, many other variations or modifications conforming to the principle of the present invention still can be directly determined or deduced according to the content disclosed by the present invention without departing from the spirit and the scope of the present invention. Thus, the scope of the present invention should be understood and affirmed to cover all these other variations or modifications.

The invention claimed is:

1. An air-cooled refrigerator supplying air through a centrifugal fan, comprising:

a bottom liner defining a cooling chamber and a storage space, wherein the cooling chamber is arranged below the storage space;

an air duct back plate which is arranged in front of a rear wall of the bottom liner and defines, with the rear wall of the bottom liner, an air supply duct, wherein the air duct back plate is provided with at least one air supply port used for communicating with the air supply duct and the storage space; and the centrifugal fan, comprising:

a volute arranged at a rear portion of the cooling chamber in a manner of upwards inclining from front to back and internally defining a fan cavity located in a front portion and a gradually-widened exhaust cavity located at a rear portion of the fan cavity, wherein the fan cavity is in a continuous helix shape, an upper cover of the fan cavity is provided with an air inlet towards a front-upper direction, the gradually-widened exhaust cavity is gradually widened backwards from the fan cavity, and an air outlet connected to a lower end of the air supply duct is formed in a rear end of the exhaust cavity; and an impeller arranged in the fan cavity, wherein an axis of the impeller is opposite to the air inlet, to promote formation of refrigeration airflow exhausted to the air supply duct from the cooling chamber, and an inner wall surface of the fan cavity is in continuous and smooth transition so as to avoid a turning point, wherein starting from the air outlet, a side wall of a transverse side of the gradually-widened exhaust cavity is inwards gradually concaved from back to front and is finally connected to a side wall of the fan cavity so as to form a volute tongue with the side wall of the fan cavity, and a side wall of the other transverse side of the gradually-widened exhaust cavity is in a plane shape extending front and back; and the side wall of the fan cavity is in a continuous logarithmic spiral from the volute tongue, and is finally connected to a front end of the plane-shaped side wall of the gradually-widened exhaust cavity.

2. The air-cooled refrigerator according to claim 1, wherein a distance between a center of the air inlet and the side wall of the fan cavity is gradually increased from the volute tongue to a position connected to the plane-shaped side wall of the gradually-widened exhaust cavity.

3. The air-cooled refrigerator according to claim 1, wherein distances between a center of the air inlet and side plates on two sides of the bottom liner are different, wherein the distance between the center of the air inlet and the side plate on the side, close to the volute tongue, of the bottom liner is greater than the distance between the center of the air inlet and the side plate on the side, close to the plane-shaped side wall of the gradually-widened exhaust cavity, of the bottom liner.

4. The air-cooled refrigerator according to claim 1, wherein the volute comprises:

a fan bottom shell fixed to a rear portion of a bottom wall of the bottom liner; and a fan upper cover obliquely downwards extending into the cooling chamber from a lower end of the air duct back plate and covering and buckling the fan bottom shell.

5. The air-cooled refrigerator according to claim 4, wherein the fan upper cover and the air duct back plate are an integrally-formed part.

6. The air-cooled refrigerator according to claim 5, wherein a position, below the air supply port, of the air duct back plate is further provided with at least one transversely extending water stop rib used for stopping condensate water at the air supply port from downwards flowing into the volute.

7. The air-cooled refrigerator according to claim 4, further comprising:

an evaporator which is integrally in a flat cuboid shape and is arranged at a front portion of the cooling chamber; and the bottom wall of the bottom liner comprising:

an evaporator support portion used for supporting the evaporator; and a fan support portion, from a rear end of the evaporator support portion, upwards obliquely arranged from front to back, wherein the fan bottom shell is fixed to the fan support portion.

8. The air-cooled refrigerator according to claim 7, wherein a bottom of the fan bottom shell is provided with a plurality of damping sticky pads, and the fan bottom shell is bonded with the fan support portion through the plurality of damping sticky pads.

9. The air-cooled refrigerator according to claim 4, wherein the fan bottom shell is further provided with a wiring channel used for accommodating a cable connecting the impeller.

10. The air-cooled refrigerator according to claim 7, wherein the bottom wall of the bottom liner further comprises: an inclined portion provided in front of the evaporator and downwards obliquely arranged from front to back from a front end of the bottom wall of the bottom liner;

the evaporator support portion is upwards obliquely arranged from front to back so that the evaporator is obliquely arranged in the cooling chamber; and a drainage channel is formed between the inclined portion and the evaporator support portion to receive defrosted water from the evaporator.

11. The air-cooled refrigerator according to claim 9, wherein the wiring channel is located in an outer surface of the fan bottom shell and is formed by concaving a bottom of the fan bottom shell inwards.

12. The air-cooled refrigerator according to claim 11, wherein the fan bottom shell is further provided with an elastic wire pressing plate on the wiring channel, and a wire hole located at an end of the wiring channel extending towards a center of the fan bottom shell.

* * * * *